US010181668B2

(12) United States Patent
Rust

(10) Patent No.: US 10,181,668 B2
(45) Date of Patent: Jan. 15, 2019

(54) SPRING CONTACTS AND RELATED METHODS

(71) Applicant: Bal Seal Engineering, Inc., Foothill Ranch, CA (US)

(72) Inventor: Stephen Rust, Beaumont, CA (US)

(73) Assignee: Bal Seal Engineering, Inc., Foothill Ranch, CA (US)

( * ) Notice: Subject to any disclaimer, the term of this patent is extended or adjusted under 35 U.S.C. 154(b) by 0 days.

(21) Appl. No.: 15/632,115

(22) Filed: Jun. 23, 2017

(65) Prior Publication Data

US 2017/0373425 A1 Dec. 28, 2017

Related U.S. Application Data

(60) Provisional application No. 62/354,580, filed on Jun. 24, 2016.

(51) Int. Cl.
*H01R 13/33* (2006.01)
*H01R 13/24* (2006.01)
*H01R 39/08* (2006.01)

(52) U.S. Cl.
CPC ..... *H01R 13/2421* (2013.01); *H01R 39/08* (2013.01)

(58) Field of Classification Search
CPC ..... H01R 13/2421; H01R 39/08
USPC ..... 439/29, 840, 841
See application file for complete search history.

(56) References Cited

U.S. PATENT DOCUMENTS 2,162,104 A 6/1939 Mosher
2,168,818 A 8/1939 Condon
3,174,500 A 3/1965 Johnson et al.
4,245,881 A * 1/1981 Michaels ..... H01R 13/187 439/841
4,647,230 A 3/1987 Friedrich et al.
4,655,462 A 4/1987 Balsells
4,678,210 A 7/1987 Balsells
4,805,943 A 2/1989 Balsells
4,872,710 A 10/1989 Konecny et al.
4,907,788 A 3/1990 Balsells
4,964,204 A 10/1990 Balsells
5,030,109 A * 7/1991 Dery ..... H01R 12/52 439/66

(Continued)

FOREIGN PATENT DOCUMENTS

DE 685738 C 12/1939
DE 1575099 A1 1/1970

(Continued)

OTHER PUBLICATIONS

Extended European Search Report from European Patent Office on related EP application (EP13193185.9) dated Mar. 16, 2015.

*Primary Examiner* — Khiem Nguyen

(74) *Attorney, Agent, or Firm* — Klein, O'Neill & Singh, LLP

(57) ABSTRACT

A dual spring contact assembly having an intermediate component between at least two canted coil springs with opposite canting angle directions for fitment between a first component and a second component. When there is relative displacement between the first and second components, the direction of movement of one of the components relative to one of the canted coil spring can always occur along the canting angle, reducing the friction between coils and component and increasing the life of the slip ring.

30 Claims, 10 Drawing Sheets

(56) References Cited

U.S. PATENT DOCUMENTS

| | | | |
|---|---|---|---|
| 5,052,782 | A | 10/1991 | Myer |
| 5,082,390 | A | 1/1992 | Balsells |
| 5,161,806 | A | 11/1992 | Balsells |
| 5,411,348 | A | 5/1995 | Balsells |
| 5,433,456 | A | 7/1995 | Nicholson |
| 5,503,375 | A | 4/1996 | Balsells |
| 5,545,842 | A | 8/1996 | Balsells |
| 5,570,719 | A | 11/1996 | Richards et al. |
| 5,791,657 | A | 8/1998 | Cain et al. |
| 5,807,146 | A | 9/1998 | Baker |
| 5,992,856 | A | 11/1999 | Balsells et al. |
| 6,672,565 | B2 | 1/2004 | Russell |
| 6,835,084 | B2 | 12/2004 | Poon et al. |
| 6,918,595 | B2 | 7/2005 | Proper |
| 7,055,812 | B2 | 6/2006 | Balsells |
| 7,274,964 | B2 | 9/2007 | Balsells |
| 7,538,289 | B2 | 5/2009 | Carroll |
| 7,640,841 | B2 | 1/2010 | An et al. |
| 7,722,415 | B2 | 5/2010 | Changsrivong |
| 7,914,315 | B2 | 3/2011 | Kuhn et al. |
| 7,914,351 | B2 | 3/2011 | Balsells et al. |
| 7,999,202 | B2 | 8/2011 | Fujita et al. |
| 8,052,459 | B2 | 11/2011 | Smith et al. |
| 8,096,842 | B2 | 1/2012 | Poon et al. |
| 8,308,167 | B2 | 11/2012 | Balsells et al. |
| 8,375,543 | B1 | 2/2013 | Balsells |
| 8,382,532 | B2 | 2/2013 | Sjostedt et al. |
| 8,491,346 | B2 | 7/2013 | Sjostedt et al. |
| 8,544,850 | B2 | 10/2013 | Balsells et al. |
| 8,561,274 | B2 | 10/2013 | Balsells |
| 9,004,805 | B2 | 4/2015 | Changsrivong et al. |
| 9,267,526 | B2 | 2/2016 | Balsells |
| 9,284,970 | B2 | 3/2016 | Dilmaghanian et al. |
| 9,293,849 | B2 * | 3/2016 | Balsells ..... H01R 13/03 |
| 9,312,630 | B2 | 4/2016 | Huang |
| 9,482,255 | B2 | 11/2016 | Changsrivong et al. |
| 9,500,211 | B2 | 11/2016 | Changsrivong |
| 9,534,625 | B2 | 1/2017 | Balsells |
| 9,677,587 | B2 | 6/2017 | Changsrivong et al. |
| 2002/0122690 | A1 | 9/2002 | Poon et al. |
| 2003/0094812 | A1 | 5/2003 | Balsells |
| 2003/0096526 | A1 | 5/2003 | Balsells |
| 2004/0175229 | A1 | 9/2004 | Balsells |
| 2005/0212218 | A1 | 9/2005 | Balsells |
| 2006/0022414 | A1 | 2/2006 | Balsells |
| 2006/0083582 | A1 | 4/2006 | Balsells |
| 2006/0228166 | A1 | 10/2006 | Balsells |
| 2010/0029145 | A1 | 2/2010 | Balsells et al. |
| 2010/0064490 | A1 | 3/2010 | Balsells |
| 2010/0090379 | A1 | 4/2010 | Balsells |
| 2010/0279558 | A1 | 11/2010 | Leon et al. |
| 2011/0006486 | A1 | 1/2011 | Niknezhad |
| 2011/0037234 | A1 | 2/2011 | Balsells et al. |
| 2011/0062640 | A1 | 3/2011 | Leon |
| 2011/0280653 | A1 | 11/2011 | Sjostedt et al. |
| 2012/0034804 | A1 | 2/2012 | Smith et al. |
| 2012/0134742 | A1 | 5/2012 | Changsrivong et al. |
| 2013/0149029 | A1 | 6/2013 | Changsrivong et al. |
| 2013/0149031 | A1 | 6/2013 | Changsrivong et al. |
| 2013/0288501 | A1 | 10/2013 | Russell et al. |
| 2014/0130329 | A1 | 5/2014 | Changsrivong et al. |
| 2014/0162487 | A1 | 6/2014 | Frederick et al. |
| 2014/0259617 | A1 | 9/2014 | Kompa et al. |
| 2014/0378008 | A1 | 12/2014 | Young et al. |
| 2016/0076568 | A1 | 3/2016 | Dilmaghanian et al. |
| 2016/0204557 | A1 | 7/2016 | Kim |
| 2016/0265574 | A1 | 9/2016 | Ghasiri |
| 2017/0352984 | A1 | 12/2017 | Changsrivong et al. |
| 2017/0373425 | A1 | 12/2017 | Rust |

FOREIGN PATENT DOCUMENTS

| | | |
|---|---|---|
| DE | 19807663 | 9/1999 |
| EP | 2157340 A1 | 2/2010 |
| GB | 2194298 | 3/1988 |
| WO | WO 97/22830 A1 | 6/1997 |
| WO | WO 03067713 | 8/2003 |

* cited by examiner

SPRING CONTACTS AND RELATED METHODS

FIELD OF ART

The present invention generally relates to a canted coil spring contact and more particularly to a dual canted coil spring contact and related methods.

BACKGROUND

Typically, a canted coil spring can be used as a slip ring within rotary applications to provide electrical contact while allowing rotation between separate parts, such as between a first component and a second component. Due to the canted nature of canted coil springs, lower frictional or slipping forces are observed in, for instance, one rotational direction than an opposite rotational direction.

Even though the slip ring has a good performance when the rotational direction is in the preferred direction, wear caused by friction can dramatically reduce the life of the slip ring and hinder the electrical contact capabilities when the rotational direction is against the preferred direction. Moreover, such friction can generate additional heat on the areas of contact. Such hindrance might take place in an electrical contact application wherein there is intermittent clockwise and counterclockwise relative rotation between the first component and the second component, such as between a shaft and a housing where a canted coil spring is used as a slip ring to connect the shaft to the housing. Along with the reduction in slip ring life, the spring must be replaced when proper electric contact is lost.

SUMMARY

One or more embodiments of the present application can be directed towards a connector assembly. The connector assembly includes a first component including a first contact surface and a second component including a second contact surface. Additionally, the connector assembly includes a first canted coil spring having a canting angle along a first canting direction, the first canted coil spring can be in contact with the first contact surface, and a second canted coil spring, the second canted coil spring oriented such that the second canted coil spring can have a canting angle along a second canting direction opposite the first canting direction, the second canted coil spring can be in contact with the second contact surface. Also, the connector assembly includes an intermediate component in contact with the first canted coil spring and the second canted coil spring, and separating the first canted coil spring and the second canted coil spring from one another.

Movement of the first component relative to the second component can result in movement of the first canted coil spring relative to the first contact surface or the intermediate component when a direction of the movement of the first component relative to the second component is along the first canting direction.

Alternatively, movement of the first component relative to the second component can result in movement of the second canted coil spring relative to the second contact surface or the intermediate component when the direction of the movement of the first component relative to the second component is along the second canting direction.

Embodiments include wherein the first canted coil spring and the second canted coil spring are spring rings and are concentric or coaxial with one another.

In some embodiments, the first canted coil spring can be in electrical contact with the first contact surface and the second canted coil spring can be in electrical contact with the second contact surface.

Also, embodiments can provide that the first canted coil spring can provide a conductive path between the first contact surface and the intermediate component, and the second canted coil spring can provide a conductive path between the second contact surface and the intermediate component.

Additionally, embodiments include wherein the first canted coil spring in conjunction with the intermediate component and the second canted coil spring can provide a conductive path between the first component and the second component.

In some embodiments, the first canted coil spring and the second canted coil spring can have coils having one of the following shapes of a square profile, a triangle profile, a single bump profile, and a double bump profile.

In embodiments, one of a grease, a conductive grease, and a lubricant can be applied to one of the first canted coil spring, the second canted coil spring, and the intermediate component.

Also, embodiments provide that a conductive plating or a wear resistance plating can be applied to one of the first canted coil spring, the second canted coil spring, the intermediate component, the first component, and the second component.

Embodiments include wherein a retaining wire can be configured to retain one of the first canted coil spring and the second canted coil spring to the intermediate component.

In some embodiments, the connector assembly includes a third canted coil spring. The intermediate component can have two rings concentrically arranged, wherein the third canted coil spring can be between and contacts the two rings. The third canted coil spring having a canting angle oriented similarly to one of the first canted coil spring and the second canted coil spring.

In some embodiments, the connector assembly includes a third canted coil spring and a fourth canted coil spring. The third canted coil spring can be in contact with the first contact surface and the intermediate component. The third canted coil spring can be oriented in a same canting direction as the first canted coil spring. The fourth canted coil spring can be in contact with the second contact surface and the intermediate component. The fourth canted coil spring can be oriented in a same canting direction as the second canted coil spring and against the first canted coil spring.

One or more embodiments of the present application are directed towards a connector assembly having a first component comprising a first contact surface, a second component comprising a second contact surface, a first canted coil spring, and a second canted coil spring. The first canted coil spring can be oriented such that the first canted coil spring has a canting angle opposite that of the second canted coil spring. The first canted coil spring can be in contact with the first contact surface and the second canted coil spring is in contact with the second contact surface. In this way, the first canted coil spring can be in contact with the second canted coil spring. Accordingly, movement of the first component relative to the second component can result in movement of the first canted coil spring relative to the first contact surface when a direction of the movement is against the canting angle of the first canted coil spring. The movement of the first component relative to the second contact surface can result in movement of the second canted coil spring relative to the second contact surface when the direction of the movement is along the canting angle of the first canted coil spring.

Embodiments include wherein the first canted coil spring and the second canted coil spring can be spring rings and are concentric with one another.

In some embodiments, the first canted coil spring can be in electrical contact with the first contact surface and the second canted coil spring can be in electrical contact with the second contact surface.

Additionally, embodiments include wherein the first canted coil spring can be in electrical contact with the second canted coil spring.

Also, embodiments provide that the first canted coil spring in conjunction with the second canted coil spring can provide a conductive path between the first component and the second component.

In some embodiments, the first canted coil spring can be attached to the second canted coil spring by means of welding.

Additionally, embodiments include wherein the first canted coil spring can be attached to the second canted coil spring by means of fastening or tying using wire or thread.

In embodiments, the first canted coil spring and the second canted coil spring can have coils having one of the following shapes of a square profile, a triangle profile, a single bump profile, and a double bump profile.

One or more embodiments of the present application are directed towards an electromagnetic interference (EMI) shielding connector assembly. The EMI shielding connector assembly includes a first component including a first contact surface and a second component including a second contact surface. Additionally, the connector assembly includes a first canted coil spring having a canting angle along a first canting direction, the first canted coil spring can be in contact with the first contact surface, and a second canted coil spring, the second canted coil spring can be oriented such that the second canted coil spring has a canting angle along a second canting direction opposite the first canting direction, the second canted coil spring can be in contact with the second contact surface. Also, the connector assembly includes an intermediate component in contact with the first canted coil spring and the second canted coil spring, and separating the first canted coil spring and the second canted coil spring from one another.

Movement of the first component relative to the second component can result in movement of the first canted coil spring relative to the first contact surface or the intermediate component when a direction of the movement of the first component relative to the second component is along the first canting direction.

Alternatively, movement of the first component relative to the second component can result in movement of the second canted coil spring relative to the second contact surface or the intermediate component when the direction of the movement of the first component relative to the second component is along the second canting direction.

Embodiments include wherein the first canted coil spring and the second canted coil spring can be spring rings and are concentric or coaxial with one another.

Embodiments include wherein the first canted coil spring can be in electrical contact with the first contact surface and the second canted coil spring can be in electrical contact with the second contact surface.

Also, embodiments of the EMI shielding connector assembly can include wherein the first canted coil spring can provide a conductive path between the first contact surface and the intermediate component, and the second canted coil spring can provide a conductive path between the second contact surface and the intermediate component.

In some embodiments, the first canted coil spring in conjunction with the intermediate component and the second canted coil spring can provide a conductive path between the first component and the second component.

In some embodiments, the first canted coil spring and the second canted coil spring can have coils having one of the following shapes of a square profile, a triangle profile, a single bump profile, and a double bump profile.

In embodiments, one of a grease, a conductive grease, and a lubricant can be applied to one of the first canted coil spring, the second canted coil spring, and the intermediate component.

Also, embodiments provide that a conductive plating or a wear resistance plating can be applied to one of the first canted coil spring, the second canted coil spring, the intermediate component, the first component, and the second component.

Embodiments of the EMI shield connector assembly include wherein a retaining wire can be configured to retain one of the first canted coil spring and the second canted coil spring to the intermediate component.

In some embodiments, the connector assembly includes a third canted coil spring. The intermediate component can have two rings concentrically arranged, wherein the third canted coil spring is between and contacts the two rings. The third canted coil spring can have a canting angle oriented similarly to one of the first canted coil spring and the second canted coil spring.

In some embodiments, the connector assembly includes a third canted coil spring and a fourth canted coil spring. The third canted coil spring is in contact with the first contact surface and the intermediate component. The third canted coil spring can be oriented in a same canting direction as the first canted coil spring. The fourth canted coil spring can be in contact with the second contact surface and the intermediate component. The fourth canted coil spring can be oriented in a same canting direction as the second canted coil spring and against the first canted coil spring.

DETAILED DESCRIPTION OF THE ILLUSTRATED EMBODIMENTS

The detailed description set forth below in connection with the appended drawings is intended as a description of the presently preferred embodiments of dual spring contact assemblies or electromagnetic interference shielding dual spring contact assemblies provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1A:
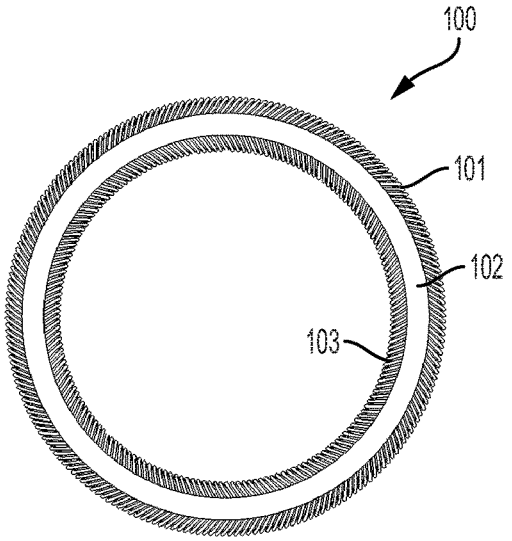
FIG. 1A illustrates a schematic front view of an exemplary embodiment of a radial dual spring contact assembly.

With reference now to FIG. 1A, a schematic front view of a radial dual spring contact assembly 100 is shown, which can be used a slip ring. A slip ring can be understood as an electromechanical device that allows the transmission of power and/or electrical signals from a stationary structure to a rotating structure. A slip ring can be used in a wide range of electromechanical systems that require rotation while transmitting to transfer power, control circuits, or analog or digital signals including data such as those found on aerodrome beacons, rotating tanks, power shovels, radio telescopes or heliostats, to name a few non-limiting examples. Slip rings are also commonly found in slip ring motors, electrical generators for alternating current (AC) systems and alternators and in packaging machinery, cable reels, and wind turbines.

The radial dual spring contact assembly 100 includes a first canted coil spring 101, an intermediate component 102, and a second canted coil spring 103. The intermediate component 102 is structured to support or retain the first canted coil spring and the second canted coil spring and may be referred to as a retention element or a retention housing. In embodiments of the radial dual spring contact assembly 100, each of the first canted coil spring 101 and the second canted coil spring 103 is comprised of a plurality of interconnected coils all canted in a same general direction. The first canted coil spring 101 and the second canted coil spring 103, however, have coils that are canted in opposite directions. For example, the first canted coil spring may have coils that are canted in a clockwise direction while the second canted coil spring may have coils that are canted in a counterclockwise direction. Both the first and second canted coil springs can be radial canted coil springs.

Figure 1B:
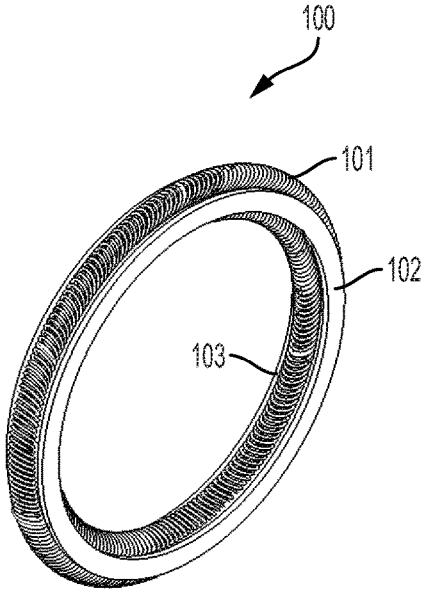
FIG. 1B illustrates an isometric view of the exemplary embodiment of the radial dual spring contact assembly

FIG. 1B shows an isometric view of a radial dual spring contact assembly 100 with a first canted coil spring 101, an intermediate component 102, and a second canted coil spring 103. Both FIGS. 1A and 1B illustrate one of the canted coil springs being canted in an opposite direction from the other. As illustrated, the second canted coil spring 103 has a smaller diameter, such as a smaller inside diameter or smaller outside diameter, than the intermediate component 102 and the first canted coil spring 101 in an assembled concentric state on an inner side of the intermediate component 102. The two canted coil springs and the intermediate component have a common central axis and are formed generally along a same plane orthogonal to the central axis.

The first canted coil spring 101 has a larger diameter, such as a larger inside diameter and/or a larger outside diameter, than the intermediate component 102 and the second canted coil spring 103 in an assembled state on an outer side of the intermediate component 102. The first canted coil spring 101 and the second canted coil spring 103 may be manufactured to substantially, or exactly, the dimensioned diameters in a free state for assembly with the intermediate component 102. Alternatively, the first canted coil spring 101 and the second canted coil spring 103 may be manufactured to different dimensions for a tensioned assembly with the intermediate component 102. For example, the first canted coil spring 101 may be stretched, or elongated, from its free state when assembled with the intermediate component 102. Similarly, the second canted coil spring 103 may be compressed, or tightened, by fitment inside of the intermediate component 102.

The two canted coil springs 101, 103 and the intermediate component 102 can each be made from a conductive metal material and can optionally be plated or coated with a second or a third outer metal layer. The two canted coil springs and the intermediate component can be sized and shaped for the particular chosen application.

Figure 2:
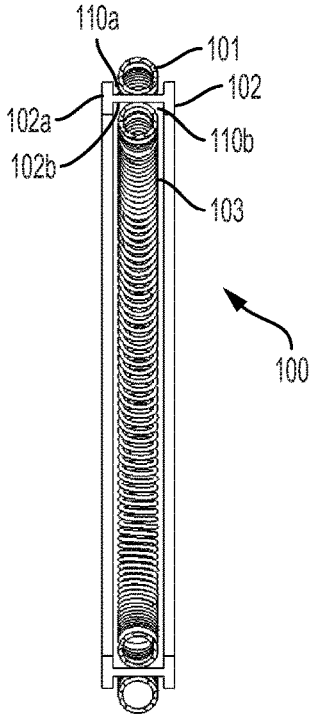
FIG. 2 illustrates a planar cross-sectional view of the exemplary embodiment taken along an axial direction of the radial dual spring contact assembly

The embodiment of FIG. 2 illustrates a planar cross-sectional view taken along an axial direction of a radial dual spring contact assembly 100. In exemplary embodiments, the first canted coil spring 101 and the second canted coil spring 103 are circular or ring shaped and each coil of a plurality of interconnected coils may be elliptical with a major axis and a minor axis. In other examples, the coil can have different shapes, such as rectangular, square, triangular, or one of the complex coil shapes shown in U.S. Publication No. 2016/0076568 (the '568 publication), the contents of which are expressly incorporated herein by reference. The cross-sectional shape of the intermediate component 102 may be that of an H-shape or I-shape. The cross-sectional shape of the intermediate component 102 can include an intermediary portion 102*b* and orthogonally arranged end portions 102*a*. The intermediary portion 102*b* is understood to be located between the two end portions. The intermediate component 102 has a first retention slot 110*a* for accommodating the first canted coil spring 102 and a second retention slot 110*b* for accommodating the second canted col spring 103.

The two end portions 102*a* can be generally parallel to one another. In other examples, the two end portions can angle outwardly or inwardly and not be generally parallel. In still other examples, each end portion 102*a* can have two terminal ends with each terminal end having a retaining lip to facilitate capturing the canted coil spring within the first and second retention slots 110*a*, 110*b*. As shown, the intermediary portion 102*b* has two sides. The first retention slot 110*a* can be located on one side of the intermediary portion 102*b* and the second retention slot 110*b* can be located on the other side of the intermediary portion. In exemplary embodiments, the two sides of the intermediary portion 102*b* can be arcuate or curved to match or more closely match the curvatures of parts of the coils of the two canted coil springs that come in contact therewith.

The I-shape or H-shape of the intermediate component 102, depending on the orientation the intermediate component is viewed, may serve to retain the first canted coil spring 101 and the second canted coil spring 103 as discussed above. However, the end portions 102*a* may not be necessary for retention, and the intermediate component 102 may have an alternative cross-sectional shape, such as a structure with only a flat intermediary portion 102*b*.

Figure 3A:
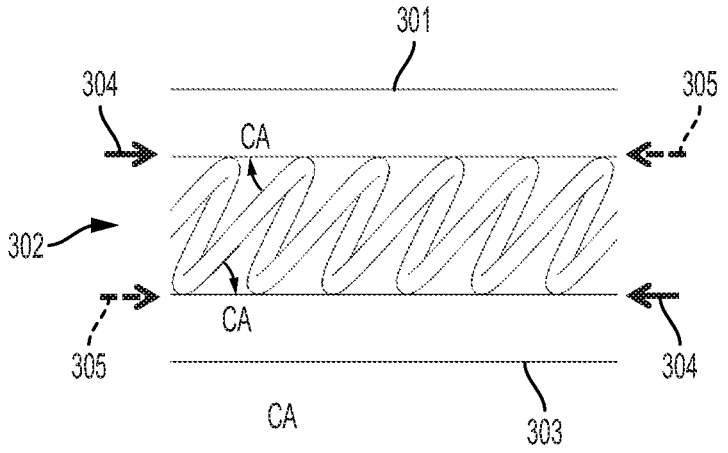
FIG. 3A illustrates a spring contact assembly with only a single slip ring contact spring.
Figure 3B:
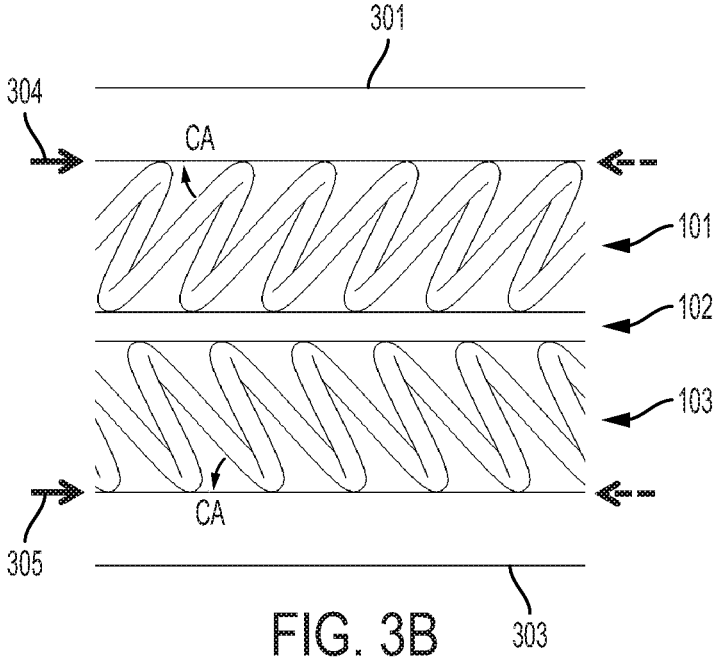
FIG. 3B illustrates a planar cross-sectional representation of an exemplary embodiment with two canted coil springs and an intermediate component.

FIGS. 3A and 3B illustrate a relationship between a displacement force and a canted coil spring in single spring and dual spring slip ring spring contact assemblies. FIG. 3A illustrates a planar cross-sectional representation of a single canted coil spring 302 located between a first component 301 and a second component 303. In the illustrated embodiment, the canting angle (CA) may be defined as the acute angle of projection of a line extending through a coil of the canted coil spring 302 onto a plane tangential to the contact surface of a component that is in contact with the coil. As shown, the canting angle (CA) may be oriented in either the clockwise or the counterclockwise direction depending on orientation.

FIG. 3A illustrates an embodiment with only a single slip ring contact spring assembly. In this type of assembly, the two canting angles (CA) of the canted coil spring 302 at contact points for the first component 301 and the second component 303 are oriented for relative movement in the same direction. Due to this arrangement, movements 304, as indicated with the solid arrows, of the first component 301 relative to the second component 303 results in movement of one or both components 301, 303 relative to the canted coil spring 303 in the direction of the corresponding canting angle (CA) when the movement is in one direction.

However, movements 305 of the first and second components, as indicated with the dotted arrows, in the opposite direction results in movement of one or both components against the corresponding canting angle (CA).

FIG. 3B illustrates a planar cross-sectional representation of the canting angles of two canted coil springs 101, 103 with opposite canting angles and an intermediate component 102. In the exemplary embodiment, the first component 301 is in contact with the first canted coil spring 101, the first canted coil spring 101 is in contact with the intermediate component 102, the intermediate component 102 is in contact with the second canted coil spring 103, and the second canted coil spring is in contact with the second component 303. Due to the placement of the dual canted coil springs 101, 103 and the intermediate component 102 between the two components, the canting angles (CA) at the contact portions of the canted coil springs 101, 103 with the first component 301 and the second component 303 are oriented for relative movement in opposite directions. As such, movement 304, 305 of the first component 301 relative to the second component 303 always results in movement in the direction of the canting angle (CA) of at least one of the canted coil springs 101, 103 at one of the interfaces of the first component 301, the intermediate component 102, and the second component 303. Therefore, movement of one of the first component 301 and the second component 303 can always occur aligned with a canting angle (CA), and not against it.

Figure 4A:
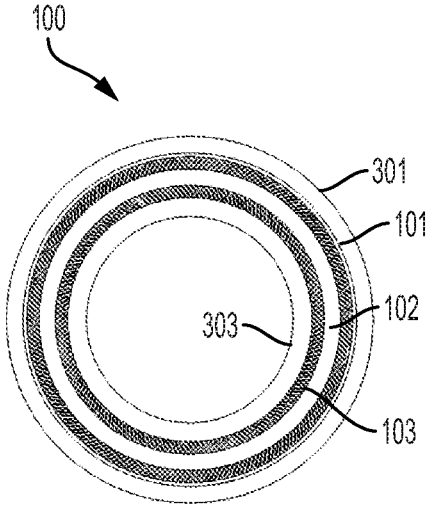
FIG. 4A illustrates a schematic front view of an exemplary embodiment of a radial dual spring contact assembly shown assembled between a first component and a second component.

With reference now to FIG. 4A, a schematic front view of an exemplary embodiment of a radial dual spring contact assembly 100 is shown assembled between a first component 301 and a second component 303. The radial dual spring contact assembly 100 provides a contact path between the first and second components 301, 303. The radial dual spring contact assembly includes the first canted coil spring 101, the intermediate component 102, and the second canted coil spring 103. As shown in the exemplary embodiment illustrated in FIG. 3B, the first canted coil spring 101 and the second canted coil spring 103 have coils that are canted in opposite directions, i.e. the first canted coil spring may be canted in a clockwise direction while the second canted coil spring may be canted in a counterclockwise direction.

Figure 4B:
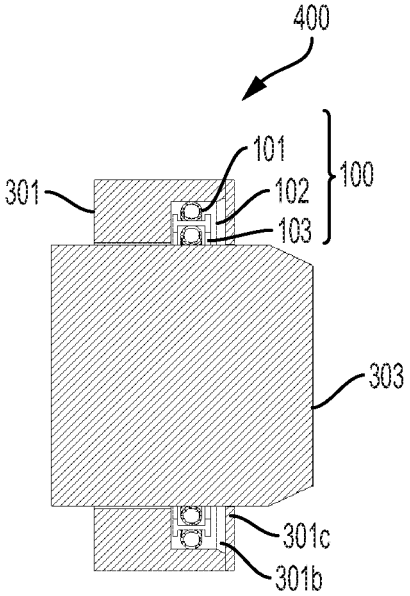
FIG. 4B illustrates a schematic cross-sectional side view of an exemplary embodiment of a radial dual spring contact assembly assembled between a first component and a second component.

FIG. 4B shows a schematic cross-sectional side view of an exemplary embodiment of a connector assembly 400. The connector assembly 400 includes the radial dual spring contact assembly 100 assembled between a first component 301 and a second component 303. The first component 301 may form a housing, and the second component 303 may form a shaft. In exemplary embodiments, the radial dual spring contact assembly may be sized for, or configured for a circumferential groove 301*b* in the first component 301, when the first component received the second component 303 in the bore of the first component 301. In this configuration, the radial dual spring contact assembly can be understood as first component-mounted, such as being housing mounted if the first component is a housing. The second component can have a tapered insertion end to facilitate insertion into the central opening of the radial dual spring contact assembly. The groove 301*b* may be shielded from foreign debris by a dust cover 301*c*.

Alternatively, the second component 303 may have a groove for receiving the radial dual spring contact assembly, which can be second component-mounted or shaft mounted if the second component is a shaft. Still, in other embodiments, both of the first component 301 and the second component 303 may have grooves for receiving the radial dual spring contact assembly in a common groove defined by the groove of the first component 301 and the groove of the second component 303. For example, in some alternative embodiments, one of the first component 301 and the second component 303 may have a groove to receive the majority of the radial dual spring contact assembly with part of the radial dual spring contact assembly extending out of the groove while the other component may have a relatively smaller groove to receive the spring that projects out of the larger groove. By larger, the groove can be deeper, wider, or both deeper and wider than the smaller groove. The larger groove that holds the radial dual spring contact assembly can have two sidewalls and a bottom wall located between the two sidewalls. The two sidewalls can have generally parallel sidewalls. The smaller groove that receives part of the radial dual spring contact assembly that projects out of the larger groove can have two generally parallel sidewalls or at least one sidewall that is tapered or not positioned at a right angle to the bottom wall.

Figure 5:
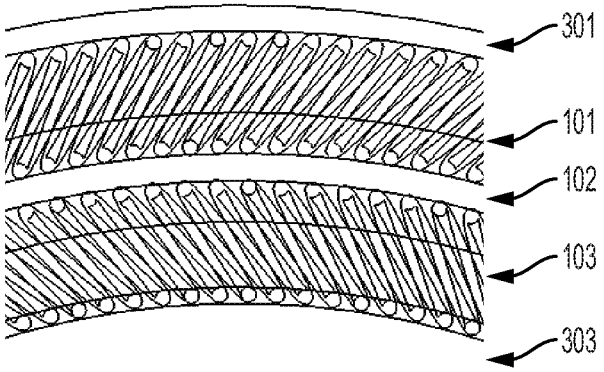
FIG. 5 illustrates a schematic front cross-section view of a radial dual spring contact assembly.

A schematic front cross-section view of a radial dual spring contact assembly 100 is shown in FIG. 5. FIG. 5 further illustrates an embodiment of the radial dual spring contact assembly fitted between a first component 301 and a second component 303. The first canted coil spring 101 is arranged such that the canting angle is in a direction opposite to the canting angle of the second canted coil spring 103. Through the dual spring arrangement between the first component 301 and the second component 303, such a configuration of the springs can reduce friction in the slip ring assembly of the first component 301 and the second component 303 during rotation.

As disclosed, the dual spring contact assembly allows for the displacement, such as rotation, of the first component 301 relative to the first canted coil spring 101 along the canting angle (CA) direction of the first canted coil spring 101 when the rotation is in one direction, as well as the displacement of the second component 303 relative to the second canted coil spring 103 along the canting angle (CA) direction of the second canted coil spring 103 when the rotation is in the opposite direction. The reduction in friction between the radial dual spring contact assembly and the components that contact the springs during rotation can increase the life of the slip ring and reduce the amount of debris generated during slip between components. In this way, continued electrical contact between the components that contact the two canted coil springs and the radial dual spring contact assembly can be improved.

Figure 6:
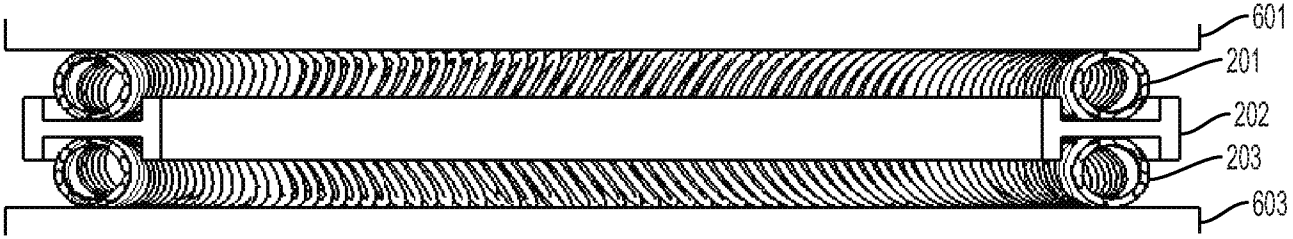
FIG. 6 illustrates a schematic cross-sectional view of an exemplary embodiment of an axial dual spring contact assembly.

FIG. 6 shows a schematic cross-sectional view of an axial dual spring contact assembly 100 including a first canted coil spring 201, an intermediate component 202, and a second canted coil spring 203. Both canted coil springs 201, 203 in the present embodiment can be axial canted coil springs, which have interconnected coils that deflect when a force in the direction of the spring ring axis is applied to the coils. The axial dual spring contact assembly 100 is assembled between a first component 601 and a second component 603, wherein the first canted coil spring 201 and the second canted coil spring 203 of the axial dual spring contact assembly 100 are configured to move or cant in an axial direction of the axial dual spring contact assembly 100. As such, the first component 601 and the second component 603 can be arranged end-to-end with the axial dual spring contact assembly 100 located therebetween.

FIG. 6 shows an embodiment of a first canted coil spring 201 and a second canted coil spring 203 in contact with an intermediate component 202, wherein the axial canting angle of the first canted coil spring 201 is opposite in direction to the axial canting angle of the second canted coil spring 203. With this arrangement, the configuration of the canted coiled springs 201, 203 allows for displacement of the first component 601 relative to the first canted coil spring 201 along the canting angle direction of the first canted coil spring 201 when the rotation is in one direction, and the displacement of the second component 603 relative to the second canted coil spring 203 along the canting angle direction of the second canted coil spring 203 when the rotation is in the opposite direction.

While exemplary embodiments that are illustrated and disclosed below show radial canted coil springs or axial canted coil springs in particular arrangements, the alternative configurations described herein would be applicable to the alternative radial canted coil spring or axial canted coil spring applications with corresponding considerations in view of the present disclosure.

Figure 7A:
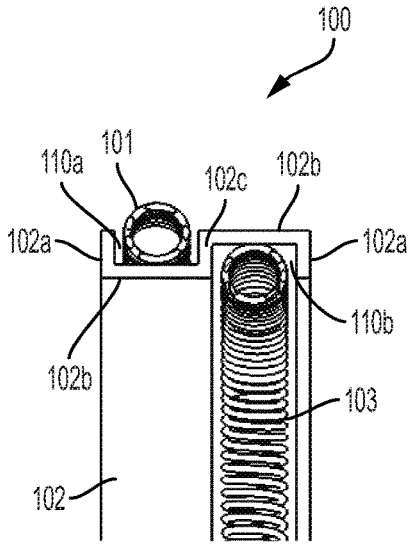
FIGS. 7A and 7B illustrate a schematic cross-sectional view of an exemplary embodiment of an axial offset configuration of a radial dual spring contact assembly.
Figure 7B:
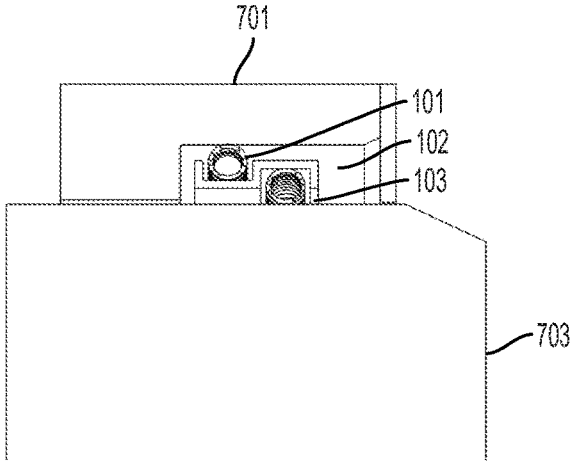

The exemplary embodiment of FIGS. 7A and 7B illustrate a schematic cross-sectional view of an axial offset configuration of the radial dual spring contact assembly 100. FIG. 7A shows the radial dual spring contact assembly 100 with the first canted coil spring 101 and the second canted coil spring 103 offset from one another by means of the intermediate component 102, which may be referred to as a retention element or a retention housing. The embodiment illustrates an axial offset between the first canted coil spring 101 and the second canted coil spring 103, which is an offset along an axial direction relative to the axis of the bore of the radial dual spring contact assembly 100. FIG. 7B shows the radial dual spring contact assembly 100 located in a groove of a first component 701 with the first radial canted coil spring 101 in contact with the first component and the second canted coil spring 103 in contact with a second component 703. The second component 703 is shown without an external groove for receiving the second canted coil spring 103 but optionally can be incorporated.

The intermediate component 102 of FIG. 7A provides the axial offset of the first canted coil spring 101 and the second canted coil spring 103. Each of the first canted coil spring 101 and the second canted coil spring 103 contact portions of the intermediary portion 102*b* of the intermediate component 102 on opposed sides of the intermediary portion. The intermediate component 102 has end portions 102*a* and an offset portion 102*c* that creates an offset of the intermediary portion 102*b* and can be referred to as an intermediary offset portion. The offset portion 102*c* is understood as extending from the intermediary portion 102*b* and provides a barrier between the first retention slot 110*a* and the second retention slot 110*b*.

The end portions 102*a* and the offset portion 102*c* can be generally parallel to one another. In other examples, the three can be non-parallel. For example, the end portions 102*a* can taper inwardly to form reduced openings of the first retention slot 110*a* and the second retention slot 110*b*. The offset portion 102*c* may be sized by adjusting the vertical height in order to adjust the overall height of the radial dual spring contact assembly 100. In embodiments, the cross-sectional shape of the intermediate component may be that of an S-shape. The intermediate component 102 may not require the end portions 102*a* and may have an alternative cross-sectional shape to achieve the axial offset of the first canted coil spring 101 and the second canted coil spring 103. Further, the intermediary portion 102*b* may have curved or arcuate upper and lower surfaces to more closely match the surfaces of the two canted coil springs 101, 103.

The axial offset configuration of the present dual spring contact assembly allows for contact between the first component and the second component in a similar manner to a stacked spring configuration of FIGS. 1A, 1B, 2, 3B, 4A, and 4B, while reducing the spacing needed between the first component and the second component along the radial direction. In this way, a more compact design, at least along the radial direction, may be achieved as a smaller gap may be needed between the first component 701 and the second component 703 for housing of the radial dual spring contact assembly 100. Said differently, the present dual spring contact assembly has a reduced profile along a radial direction by axially offsetting the two canted coil springs 101, 103. In contrast, the dual spring contact assembly of can have a reduced profile along an axial direction by stacking the two canted coil springs, as shown in FIGS. 1A, 1B, 2, 3B, 4A, and 4B. As previously described, the canting angle (CA) of the first canted coil spring 101 is opposite in direction to the canting angle (CA) of the second canted coil spring 103. The configuration of FIG. 7A can be applied to an axial dual spring contact assembly with a radial offset of the canted coil springs.

FIG. 7B illustrates a cross-sectional view of the radial dual spring contact assembly 100 fitted between the first component 701 and the second component 703. The first canted coil spring 101 is shown in contact with the first component 701 but spaced from the second component 703. The second canted coil spring 103 is shown in contact with the second component 703 but spaced from the first component 701.

Figure 8A:
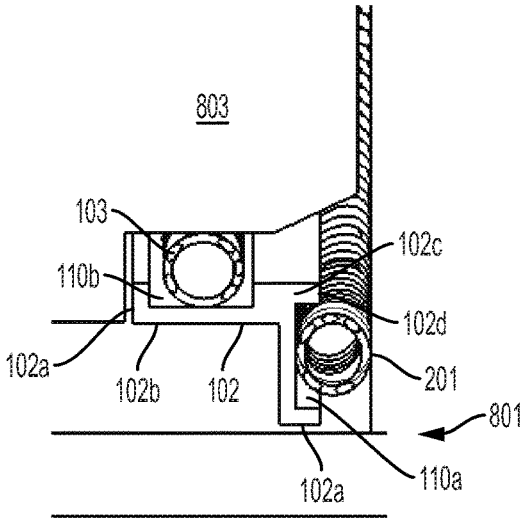
FIG. 8A illustrates a cross-sectional view of an exemplary embodiment of a combination radial-axial dual spring contact assembly fitted between a first component and a second component.

FIG. 8A illustrates a cross-sectional view of a combination radial-axial dual spring contact assembly 100 fitted between a first component 801 and a second component 803. The radial-axial dual spring contact assembly 100 includes a radial canted coil spring 103, an intermediate component 102, and an axial canted coil spring 201.

Figure 8B:
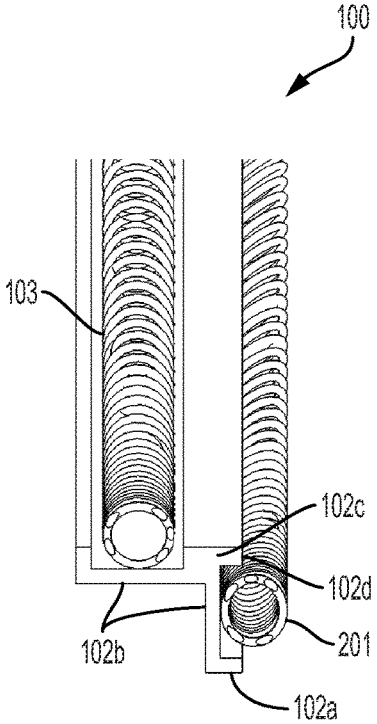
FIG. 8B shows the combination radial-axial dual spring contact assembly separate from the first component and the second component

FIG. 8B shows the radial-axial dual spring contact assembly 100 separated from the first and second components. The radial-axial dual spring contact assembly 100 includes the radial canted coil spring 103, the intermediate component 102, and the axial canted coil spring 201, wherein the intermediate component 102 is sized and shaped to retain the two canted coil springs in the first retention slot 110*a* and the second retention slot 110*b* such that the radial canted coil spring 103 can contact the second component 803 and be deflectable by the second component radially and the axial canted coil spring 201 can contact the first component 801 and be deflectable by the first component axially.

The intermediate component 102 of the present embodiment includes an intermediary portion 102*b* for contact with the radial canted coil spring 103 and the axial canted coil spring 201. The intermediary portion 102*b* has an included angle to form two retention slots 110*a*, 110*b* for positioning two different canted coil spring types, an axial canted coil spring and a radial canted coil spring. In an example, the two sections to either side of the included angle are orthogonal to one another. The intermediary portion 102*b* also has two end portions 102*a* that are orthogonal to one another. An offset portion 102*c* is included adjacent the included angle. The offset portion 102*c* has a wall 102*d* having a section that extends generally parallel to one of the end walls 102*a* to form the first retention slot 110*a* and a section that extends generally parallel to the other end wall 102*a* to form the second retention slot 110*b*.

In FIG. 8B, the wall 102*d* of the offset portion 102*c* are provided for both canted coil springs. However, the offset portion 102*c* may only extend in one direction and provide on a wall or barrier 102*d* for one of the canted coil springs. The offset portion 102*c* may be sized by adjusting the vertical height and axial length of the wall or barrier 102*d* in order to adjust the overall size of the dual spring contact assembly 100 as well as the distance between the canted coil springs. In exemplary embodiments, the cross-sectional shape of the intermediate component 102 may be that of an L-shape. The intermediate component 102 may not require, such as omit, the end portions 102*a* and may have an alternative cross-sectional shape to achieve the axial offset of the radial canted coil spring 103 and the axial canted coil spring 201.

In this configuration, contact can occur between the first component 801 in contact with the axial canted coil spring 201 and the second component 803 in contact with the radial canted coil spring 103. As arranged, the canting angle (CA) of the axial canted coil spring 201 is opposite in direction to the canting angle (CA) of the radial canted coil spring 103. This configuration can have be arranged alternatively with the configuration of the combination of radial and axial canted coil springs.

Figure 9A:
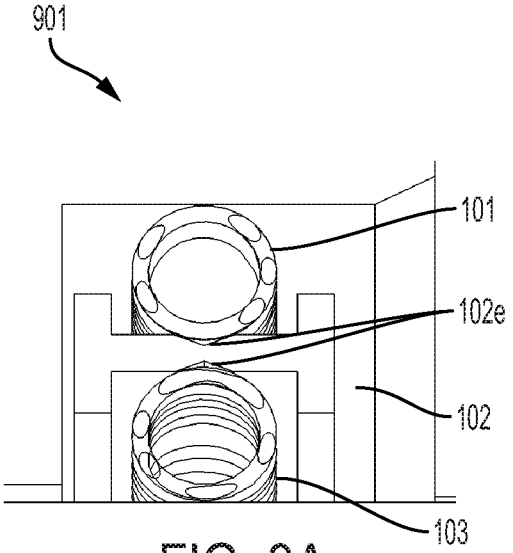
FIGS. 9A-9B illustrate a cross-sectional view of an exemplary embodiment of the radial dual spring contact assembly with an intermediate component having a V-shaped groove.
Figure 9B:
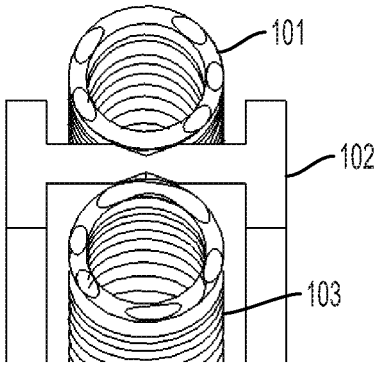

FIG. 9A illustrates a cross-sectional view of a radial dual spring contact assembly 100 having a first canted coil spring 101, an intermediate component 102, and a second canted coil spring 103, wherein the radial dual spring contact assembly 100 is fitted between a first component 901 and a second component 903. FIG. 9B illustrates the radial dual spring contact assembly 100 separate from the first component 901 and the second component 903. In the present exemplary embodiment, the intermediate component 102 has grooves 102*e* for contact with the first canted coil spring 101 and the second canted coil spring 103. In embodiments, the grooves 102*e* are V-shaped. The V-shaped grooves 102*e* can keep the canted coil springs 101, 103 in position and restricts side displacement of the canted coil springs with respect to the intermediate component 102. The angles of the V-shaped groove 102*e* can be adjusted for considerations of retention. Alternatively, the groove 102*e* can have a different shape than a V-shaped groove.

Figure 10A:
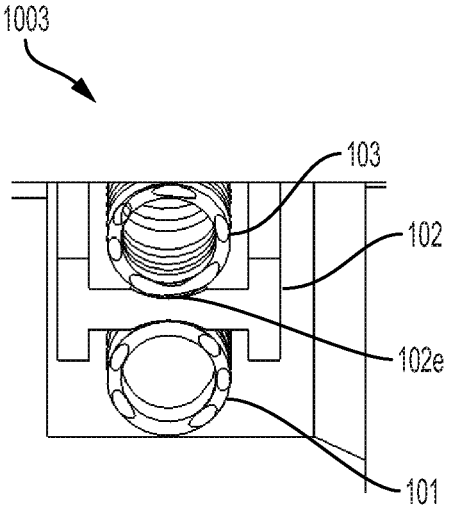
FIGS. 10A-10B illustrate a cross-sectional view of an exemplary embodiment of the radial dual spring contact assembly with an intermediate component having a U-shaped groove.

FIG. 10A shows a cross-sectional view of a radial dual spring contact assembly 100, with U-shaped grooves 102*e* formed with the intermediary portion 102*b* of the intermediate component 102, fitted between a first component 1001 and a second component 1003. The grooves 102*e* may alternatively have an arc shape.

Figure 10B:
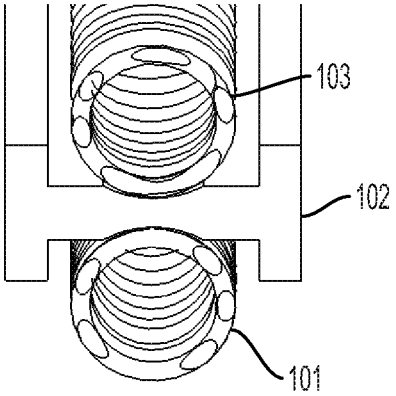

FIG. 10B illustrates the radial dual spring contact assembly 100 of FIG. 10A separate from the first component 1001 and the second component 1003. In the exemplary embodiment, the intermediate component 102 has grooves 102*e* for contact with the first canted coil spring 101 and the second canted coil spring 103, which can be radial canted coil springs. In embodiments, the grooves 102*e* are U-shaped. The U-shaped grooves 102*e* can keep the canted coil springs 101, 103 in position and restricts side displacement of the canted coil springs with respect to the intermediate component 102. The radius or radii of the U-shaped groove 102*e* can be adjusted for considerations of retention. Alternatively, the groove 102*e* can have a different shape than either a U-shaped groove or a V-shaped groove, such as having an arc shaped groove, a V-shaped groove with a subtended surface, etc.

Figure 11A:
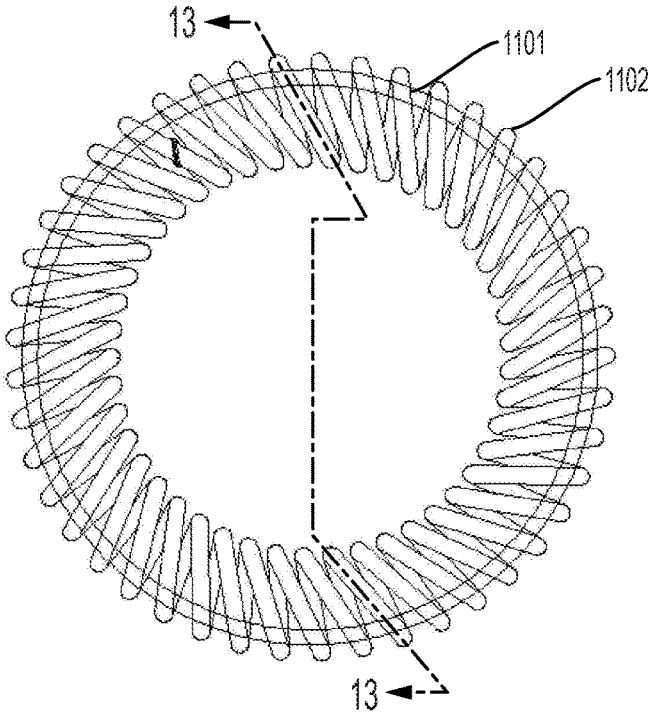
FIG. 11A-11B illustrate an exemplary embodiment of a canted coil spring having a retaining wire.
Figure 11B:
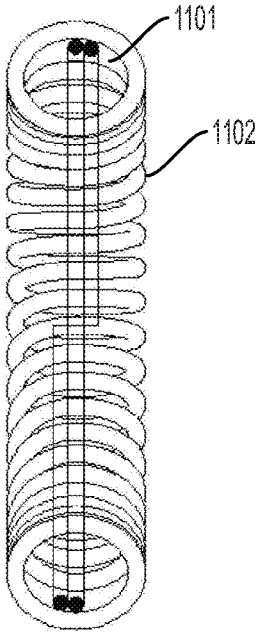

FIGS. 11A and 11B show different views of a retaining wire 1101 with a canted coil spring 1102. FIG. 11A shows a schematic front view of the retaining wire 1101 on the interior of the plurality of coils and biasing against the interior outer circumference of the canted coil spring 1102. The retaining wire 1101 can be arranged to restrict the spring 1102 from dislodging from the intermediate component 102 after assembly by providing a retraining barrier that limits the canted spring's radial expansion. In other examples, the retaining wire 1101 can be located on the interior of the plurality of coils and biasing against the interior inner circumference of the canted coil spring 1102.

FIG. 11B illustrates a cross-sectional view of the retaining wire 1101 and the canted coil spring 1102 taken along section line B-B. Exemplary disclosure of the retaining wire is provided in U.S. Patent Publication 2014/0259617, which is hereby expressly incorporated herein by reference in its entirety.

Figure 12A:
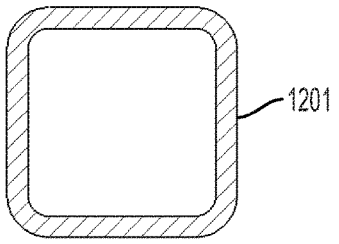
FIGS. 12A-D illustrate embodiments of variations of cross-sectional shapes for canted coil springs.
Figure 12B:
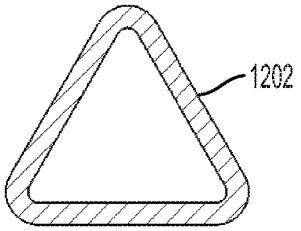
Figure 12C:
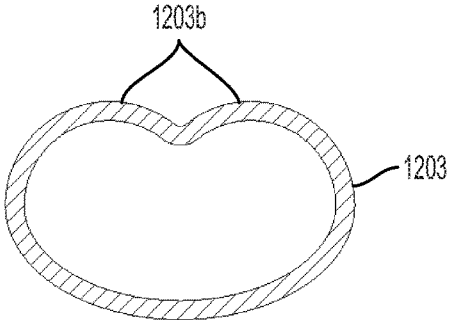
Figure 12D:
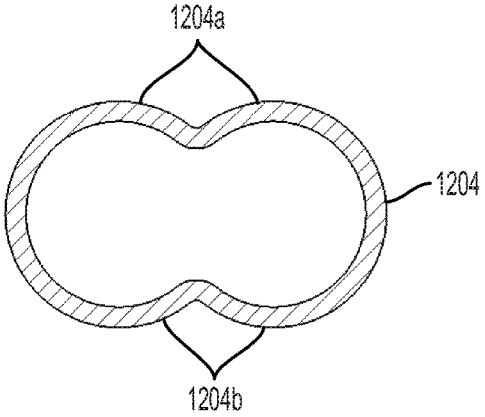

FIGS. 12A-D show variations in coil shapes for interconnected coils of different canted coil springs that are usable with the dual spring contact assemblies of the present disclosure. Each of these shaped coils, among others disclosed in the '568 publication may be considered based on the requirements necessary for individual applications. FIG. 12A shows a rectangular cross-section for a canted coil spring for use in a dual spring contact assembly. Although FIG. 12A shows a square cross-section 1201, variations of the coil shape may include unequal length portions of the coil instead of the square. FIG. 12B shows a triangular cross-section 1202 for a canted coil spring for use in a dual spring contact assembly. Although FIG. 12B shows an equilateral triangle, variations of the triangular cross-section may include alternative triangles, such as isosceles triangles. FIG. 12C shows an elliptical shape coil 1203 with a single inward bump or dimple for a canted coil spring for use in a dual spring contact assembly. Such a cross-section may provide a singular contact point on one side of the canted coil spring and two contact points 1203*b* on the other side of the canted coil spring. FIG. 12D shows two bumps or dimples for a canted coil spring for use in a dual spring contact assembly. Such a cross-section may provide two contact points on either side 1204*a*, 1204*b* of the canted coil spring.

Figure 13:
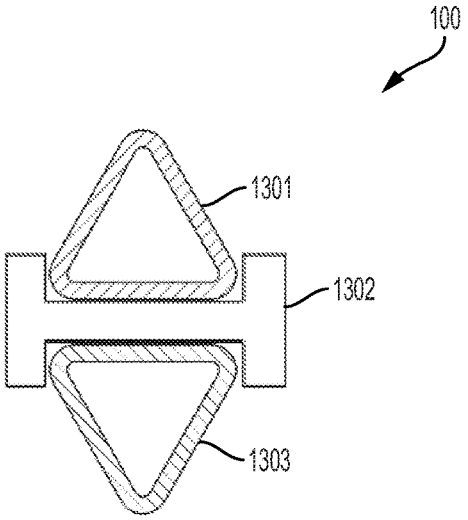
FIG. 13 illustrates a cross-sectional view of a dual spring contact assembly having canted coil springs with triangular cross-sectional shapes.

An exemplary embodiment of a dual spring contact assembly 100 is illustrated in FIG. 13. FIG. 13 shows a cross sectional view of the dual spring contact assembly 100 with a first canted coil spring 1301 having a triangular shape coil, an intermediate component 102, and a second canted coil spring 1303 having a triangular shape coil. The choice of using a canted coil spring with a plurality of interconnected coils each with a non-elliptical shape may be driven by considerations of contact area size, number of contacts, coil spacing, working range, and friction requirements for the dual spring contact assembly 100.

Additionally, more than two canted coil springs may be used in a spring contact assembly 100. Multiple springs may be arranged in configured such as stacking in FIGS. 14A-14B or side to side in FIG. 15. Said differently, one or more intermediate components may be used with variations in the radial direction, axial direction, or both radial and axial directions may be utilized to assemble two or more canted coil springs to form a spring contact assembly with multiple canted coil springs. Embodiments may also combine the configurations to have three or more springs in both stacking and side to side configurations in one spring contact assembly 100.

Figure 14A:
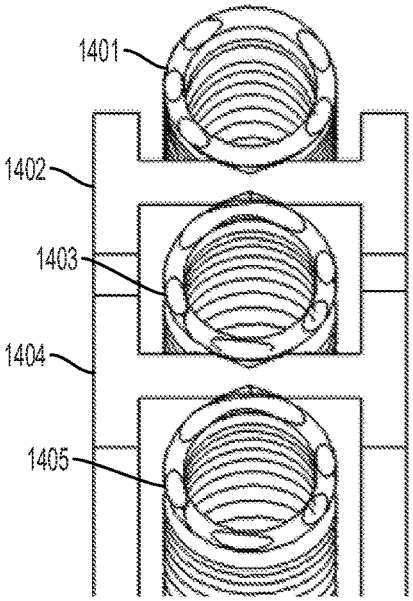
FIGS. 14A-B illustrate an exemplary embodiment of a stacked configuration multi-spring spring contact assembly.
Figure 14B:
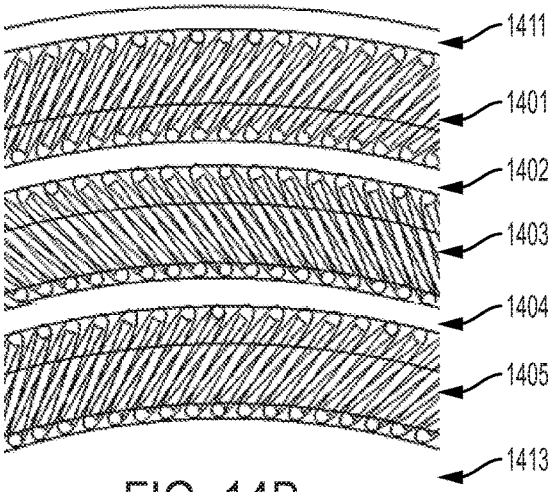

FIGS. 14A and 14B illustrate a stacking configuration of multiple springs. FIG. 14A shows a planar cross-sectional view taken along an axial direction of the spring contact assembly 100. In such a spring contact assembly 100, there is a first radial canted coil spring 1401, a first intermediate component 1402, a second radial canted coil spring 1403, a second intermediate component 1404, and a third radial canted coil spring 1405.

FIG. 14B shows a partial front sectional view of the spring contact assembly 100 as fitted between a first component 1411 and a second component 1413. In such a configuration, the first intermediate component 1402, the second radial canted coil spring 1403, and the second intermediate component 1404 are between the first canted coil spring 1401 and the third canted coil spring 1405 in the spring contact assembly 100. In the case of stacking multiple springs, three or more springs may be combined for reasons including, but not limited to, reducing velocities at each contact area or dynamic interface due rotational speed of the spring contact assembly 100 being distributed across multiple springs. As shown, the first canted coil spring 1401 and the third canted coil spring 1405 have coils that cant in the same direction and with the same or similar canting angles. In other examples, the first canted coil spring 1401 and the third canted coil spring 1405 can have coils that cant in opposite directions with different canting angles.

Figure 15:
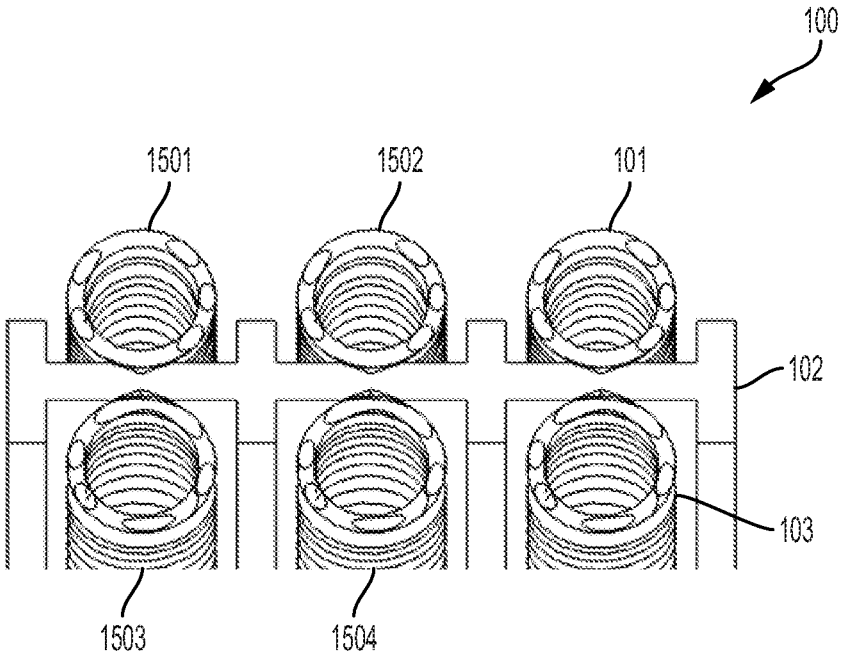
FIG. 15 illustrates an exemplary embodiment of a side to side configuration multi-spring spring contact assembly.

FIG. 15 illustrates an embodiment of a spring contact assembly 100 with multiple canted coil springs in a side to side and in a stacked configuration. As shown, the spring contact assembly 100 has a two canted coil spring stacking arrangement across the intermediate component 102. On one side of the intermediate component 102 are a first set of canted coil springs 101, 1501, 1502 arranged side to side and oriented to be canted in one direction. On the other side of the intermediate component 102 are the other canted coil springs 103, 1503, 1504 arranged side to side and oriented in an opposite direction of rotation to the first set of canted coil springs. In the case of stacking multiple springs, three or more springs may be combined for reasons including, but not limited to, contact area size, resistance considerations, or electrical conductivity considerations.

In embodiments with multiple canted coil springs side to side, it is not necessary to have the same number of canted coil springs on each side of the intermediate component 102. Additionally, in the embodiments, the intermediate component may be integrally formed, or may be comprised of two or more elements.

Figure 16:
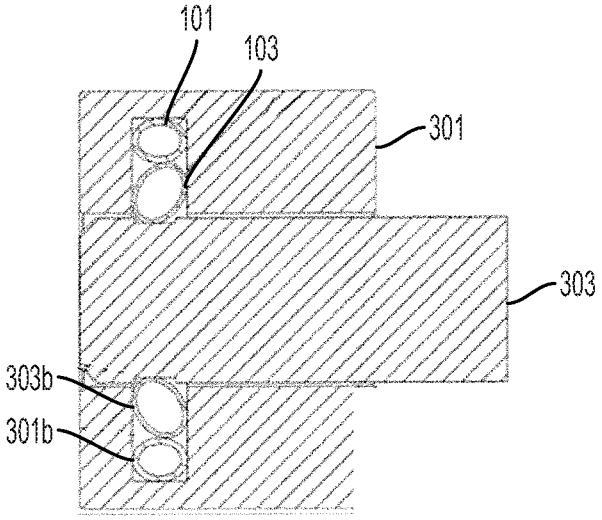
FIG. 16 illustrates an exemplary embodiment of a spring contact assembly without an intermediate component.

FIG. 16 illustrates an exemplary embodiment where the canted coil springs 101, 103 are in direct contact with one another without an intermediate component. The canted coil springs 101, 103 are still arranged with canting in opposite directions. In the exemplary illustration of FIG. 16, it is also shown that both the first component 301 and the second component 303 have grooves 301*b*, 303*b* for retaining the canted coil springs 101, 103. In embodiments where there is not an intermediate component, the canted coil springs 101, 103 may be coupled by means of welding, fastening, or tying using wire or thread.

Embodiments of the above disclosed features may also include the use of grease, conductive grease, or other lubrication. The lubrication may include wet, dry, or gel type lubricants. More than one of the above may be applied as appropriate.

Also, embodiments of the above disclosed features may use conductive or wear resistance plating or treatments on the canted coil springs to increase longevity of the spring contact assembly. Alternatively, the conductive or wear resistance plating or treatments can be applied to the intermediate component, the first component, or the second component, e.g., a shaft or housing as the spring contact assembly may be applied. At least one of the conductive or resistance plating or treatments may be applied, or multiple may be applied as appropriate. The plating or treatment may be applied to all of the components or selectively as may be appropriate.

In addition to many other applications of the spring contact assembly and the connector assembly, one embodiment in particular is for electromagnetic interference (EMI) shielding applications. For example, the entire connector assembly may be used as part of an EMI shielding application.

Aspects of the present invention further include methods of using the contact assemblies and of making the contact assemblies as described herein.

Although limited embodiments of dual spring contact assemblies or electromagnetic interference shielding dual spring contact assemblies, their components, and related methods have been specifically described and illustrated herein, many modifications and variations will be apparent to those skilled in the art. For example, the various contoured surfaces may be modified so long as a concave surface is provided to support a convex surface or vice versa and so long as the canted coil springs and the intermediate component are arranged in an arrangement to allow for accommodating slip between components. Furthermore, it is understood and contemplated that features specifically discussed for one spring embodiment may be adopted for inclusion with another spring embodiment, provided the functions are compatible. Accordingly, it is to be understood that the dual spring contact assemblies or electromagnetic interference shielding dual spring contact assemblies, their components, and related methods constructed according to principles of the disclosed devices, systems, and methods may be embodied other than as specifically described herein. The disclosure is also defined in the following claims.

What is claimed is:

1. A connector assembly comprising:

a first component comprising a first contact surface;

a second component comprising a second contact surface;

a first canted coil spring having a canting angle along a first canting direction, the first canted coil spring being in contact with the first contact surface;

a second canted coil spring, the second canted coil spring oriented such that the second canted coil spring has a canting angle along a second canting direction opposite the first canting direction, the second canted coil spring being in contact with the second contact surface; and an intermediate component in contact with the first canted coil spring and the second canted coil spring, and separating the first canted coil spring and the second canted coil spring from one another;

wherein movement of the first component relative to the second component results in movement of the first canted coil spring relative to the first contact surface or the intermediate component when a direction of the movement of the first component relative to the second component is along the first canting direction; and wherein the movement of the first component relative to the second component results in movement of the second canted coil spring relative to the second contact surface or the intermediate component when the direction of the movement of the first component relative to the second component is along the second canting direction.

2. The connector assembly according to claim 1, wherein the first canted coil spring and the second canted coil spring are spring rings and are concentric or coaxial with one another.

3. The connector assembly according to claim 1, wherein the first canted coil spring is in electrical contact with the first contact surface and the second canted coil spring is in electrical contact with the second contact surface.

4. The connector assembly according to claim 1, wherein the first canted coil spring provides a conductive path between the first contact surface and the intermediate component, and the second canted coil spring provides a conductive path between the second contact surface and the intermediate component.

5. The connector assembly according to claim 1, wherein the first canted coil spring in conjunction with the intermediate component and the second canted coil spring provides a conductive path between the first component and the second component.

6. The connector assembly according to claim 1, wherein the first canted coil spring and the second canted coil spring have coils having one of the following shapes:

a) a square profile;

b) a triangle profile;

c) a single bump profile; and d) a double bump profile.

7. The connector assembly according to claim 1, wherein one of a grease, a conductive grease, and a lubricant is applied to one of the first canted coil spring, the second canted coil spring, and the intermediate component.

8. The connector assembly according to claim 1, wherein a conductive plating or a wear resistance plating is applied to one of the first canted coil spring, the second canted coil spring, the intermediate component, the first component, and the second component.

9. The connector assembly according to claim 6, wherein a retaining wire is configured to retain one of the first canted coil spring and the second canted coil spring to the intermediate component.

10. The connector assembly according to claim 1, further comprising:

a third canted coil spring;

wherein the intermediate component comprises two rings concentrically arranged; and wherein the third canted coil spring is between and contacts the two rings, the third canted coil spring having a canting angle oriented similarly to one of the first canted coil spring and the second canted coil spring.

11. The connector assembly according to claim 1, further comprising:

a third canted coil spring; and a fourth canted coil spring;

wherein the third canted coil spring is in contact with the first contact surface and the intermediate component, the third canted coil spring being oriented in a same canting direction as the first canted coil spring; and wherein the fourth canted coil spring is in contact with the second contact surface and the intermediate component, the fourth canted coil spring being oriented in a same canting direction as the second canted coil spring and against the first canted coil spring.

12. A connector assembly comprising;

a first component comprising a first contact surface;

a second component comprising a second contact surface;

a first canted coil spring; and a second canted coil spring;

wherein the first canted coil spring is oriented such that the first canted coil spring has a canting angle opposite that of the second canted coil spring;

wherein the first canted coil spring is in contact with the first contact surface and the second canted coil spring is in contact with the second contact surface;

wherein the first canted coil spring is in contact with the second canted coil spring;

wherein movement of the first component relative to the second component results in movement of the first canted coil spring relative to the first contact surface when a direction of the movement is against the canting angle of the first canted coil spring; and wherein the movement of the first component relative to the second contact surface results in movement of the second canted coil spring relative to the second contact surface when the direction of the movement is along the canting angle of the first canted coil spring.

13. The connector assembly according to claim 12, wherein the first canted coil spring and the second canted coil spring are spring rings and are concentric with one another.

14. The connector assembly according to claim 12, wherein the first canted coil spring is in electrical contact with the first contact surface and the second canted coil spring is in electrical contact with the second contact surface.

15. The connector assembly according to claim 12, wherein the first canted coil spring is in electrical contact with the second canted coil spring.

16. The connector assembly according to claim 12, wherein the first canted coil spring in conjunction with the second canted coil spring provides a conductive path between the first component and the second component.

17. The connector assembly according to claim 12, wherein the first canted coil spring is attached to the second canted coil spring by means of welding.

18. The connector assembly according to claim 12, wherein the first canted coil spring is attached to the second canted coil spring by means of fastening or tying using wire or thread.

19. The connector assembly according to claim 12, wherein the first canted coil spring and the second canted coil spring have coils having one of the following shapes:

e) a square profile;
f) a triangle profile;
g) a single bump profile; and
h) a double bump profile.

20. An electromagnetic interference (EMI) shielding connector assembly comprising:

a first component comprising a first contact surface;
a second component comprising a second contact surface;
a first canted coil spring having a canting angle along a first canting direction, the first canted coil spring being in contact with the first contact surface;
a second canted coil spring, the second canted coil spring oriented such that the second canted coil spring has a canting angle along a second canting direction opposite the first canting direction, the second canted coil spring being in contact with the second contact surface; and
an intermediate component in contact with the first canted coil spring and the second canted coil spring, and separating the first canted coil spring and the second canted coil spring from one another;
wherein movement of the first component relative to the second component results in movement of the first canted coil spring relative to the first contact surface or the intermediate component when a direction of the movement of the first component relative to the second component is along the first canting direction; and
wherein the movement of the first component relative to the second component results in movement of the second canted coil spring relative to the second contact surface or the intermediate component when the direction of the movement of the first component relative to the second component is along the second canting direction.

21. The EMI shielding connector assembly according to claim 20, wherein the first canted coil spring and the second canted coil spring are spring rings and are concentric or coaxial with one another.

22. The EMI shielding connector assembly according to claim 20, wherein the first canted coil spring is in electrical contact with the first contact surface and the second canted coil spring is in electrical contact with the second contact surface.

23. The EMI shielding connector assembly according to claim 20, wherein the first canted coil spring provides a conductive path between the first contact surface and the intermediate component, and the second canted coil spring provides a conductive path between the second contact surface and the intermediate component.

24. The EMI shielding connector assembly according to claim 20, wherein the first canted coil spring in conjunction with the intermediate component and the second canted coil spring provides a conductive path between the first component and the second component.

25. The EMI shielding connector assembly according to claim 20, wherein the first canted coil spring and the second canted coil spring have coils having one of the following shapes:

i) a square profile;
j) a triangle profile;
k) a single bump profile; and
l) a double bump profile.

26. The EMI shield connector assembly according to claim 20, wherein one of a grease, a conductive grease, and a lubricant is applied to one of the first canted coil spring, the second canted coil spring, and the intermediate component.

27. The EMI shield connector assembly according to claim 20, wherein a conductive plating or a wear resistance plating is applied to one of the first canted coil spring, the second canted coil spring, the intermediate component, the first component, and the second component.

28. The EMI shield connector assembly according to claim 25, wherein a retaining wire is configured to retain one of the first canted coil spring and the second canted coil spring to the intermediate component.

29. The EMI shield connector assembly according to claim 20, further comprising:

a third canted coil spring;
wherein the intermediate component comprises two rings concentrically arranged; and
wherein the third canted coil spring is between and contacts the two rings, the third canted coil spring having a canting angle oriented similarly to one of the first canted coil spring and the second canted coil spring.

30. The EMI shield connector assembly according to claim 20, further comprising:

a third canted coil spring; and
a fourth canted coil spring;
wherein the third canted coil spring is in contact with the first contact surface and the intermediate component, the third canted coil spring being oriented in a same canting direction as the first canted coil spring; and
wherein the fourth canted coil spring is in contact with the second contact surface and the intermediate component, the fourth canted coil spring being oriented in a same canting direction as the second canted coil spring and against the first canted coil spring.

* * * * *